US008607813B2

(12) United States Patent
Braesel

(10) Patent No.: US 8,607,813 B2
(45) Date of Patent: Dec. 17, 2013

(54) METHOD FOR REDUCING THE AIR FEED FROM THE ATMOSPHERE INTO THE EXPANSION VESSEL OF HIGH-VOLTAGE SYSTEMS FILLED WITH INSULATING LIQUID AND DEVICE FOR CARRYING OUT THE METHOD

(75) Inventor: Eckhard Braesel, Greifswald (DE)

(73) Assignee: GATRON GmbH, Greifswald (DE)

( * ) Notice: Subject to any disclaimer, the term of this patent is extended or adjusted under 35 U.S.C. 154(b) by 592 days.

(21) Appl. No.: 12/988,157

(22) PCT Filed: Apr. 3, 2009

(86) PCT No.: PCT/EP2009/054018

§ 371 (c)(1),
(2), (4) Date: Jan. 10, 2011

(87) PCT Pub. No.: WO2009/127539

PCT Pub. Date: Oct. 22, 2009

(65) Prior Publication Data

US 2011/0114364 A1 May 19, 2011

(30) Foreign Application Priority Data

Apr. 15, 2008 (EP) ..... 08103545

(51) Int. Cl.
*F16K 13/10* (2006.01)

(52) U.S. Cl.
USPC ..... 137/253; 137/251.1; 220/748; 220/749; 174/14 R

(58) Field of Classification Search
USPC ..... 137/251.1, 252, 253, 571; 174/14 R; 220/748, 749; 95/45, 54; 96/4; 336/55, 336/59
See application file for complete search history.

(56) References Cited

U.S. PATENT DOCUMENTS 941,235 A * 11/1909 Dietrich ..... 137/252
1,100,736 A * 6/1914 Hundt ..... 220/748

(Continued)

FOREIGN PATENT DOCUMENTS

DE 904919 2/1954
DE 1788101 5/1959

(Continued)

*Primary Examiner* — John Rivell
*Assistant Examiner* — Minh Le
(74) *Attorney, Agent, or Firm* — Jordan and Hamburg LLP

(57) ABSTRACT

A method and apparatus are provided for reducing the oxygen content drawn from the atmosphere that enters the insulating fluid-containing expansion vessel of high-voltage systems. The apparatus is provided with inner and outer tanks that include a liquid that provides a diffusion barrier for capturing oxygen from the atmosphere. The tanks are in communication with the atmosphere on one side of the barrier and in communication with the expansion vessel on the other side of the barrier. Further provided is a moisture-capturing dehumidifier upstream of the diffusion barrier to dry the gas passing into the expansion vessel. The apparatus limits degradation of the insulation system caused by moisture and oxygen, thereby increasing the life span of the high-voltage system. In the method, gas is transferred from the expansion vessel to an external buffer space in the outer tank up to a pre-defined overpressure relative to atmospheric pressure, said gas being discharged to the atmosphere only when the pre-defined overpressure is exceeded. Further, gas is transferred from the external buffer space to the expansion vessel to approach to a pre-defined underpressure relative to atmospheric pressure, with either air from the atmosphere or inert gas being fed to the buffer space when pressure drops below the underpressure. The buffer space volume is correlated to lower and upper working temperatures of the insulating fluid in the high-voltage system, which temperatures are determined based on the geographical location of the system.

15 Claims, 2 Drawing Sheets

(56) References Cited

U.S. PATENT DOCUMENTS

| | | | | | |
|---|---|---|---|---|---|
| 1,243,604 | A | * | 10/1917 | Honeywell | 137/252 |
| 1,326,049 | A | * | 12/1919 | Green | 174/14 R |
| 1,456,901 | A | * | 5/1923 | Mershon | 137/209 |
| 1,518,486 | A | * | 12/1924 | Crews | 137/251.1 |
| 1,534,448 | A | * | 4/1925 | Hauser | 220/288 |
| 1,567,580 | A | * | 12/1925 | Eschholz | 174/11 R |
| 1,584,537 | A | * | 5/1926 | Hill | 174/14 R |
| 1,601,326 | A | * | 9/1926 | Rodman et al. | 174/12 R |
| 1,705,721 | A | * | 3/1929 | Dann | 174/12 R |
| 1,705,722 | A | * | 3/1929 | Dann | 174/12 R |
| 1,712,765 | A | * | 5/1929 | Hill | 174/12 R |
| 1,720,516 | A | * | 7/1929 | Hill et al. | 174/14 R |
| 1,732,719 | A | * | 10/1929 | Hill | 174/14 R |
| 1,740,477 | A | | 12/1929 | Rodman et al. | |
| 1,764,350 | A | * | 6/1930 | Rodman | 174/12 R |
| 1,872,245 | A | * | 8/1932 | Clark | 174/12 R |
| 1,953,216 | A | * | 4/1934 | Elsey | 336/94 |
| 2,117,829 | A | * | 5/1938 | Staber | 220/748 |
| 2,253,295 | A | * | 8/1941 | Higgins | 220/748 |
| 2,643,025 | A | * | 6/1953 | Bell | 137/251.1 |
| 2,654,387 | A | * | 10/1953 | Innes | 137/251.1 |
| 3,330,902 | A | * | 7/1967 | Nakazawa et al. | 174/12 R |
| 3,605,776 | A | * | 9/1971 | Fullam | 137/14 |
| 6,199,577 | B1 | * | 3/2001 | Bomber et al. | 137/251.1 |
| 7,044,327 | B2 | * | 5/2006 | Vaitses | 220/748 |
| 7,077,154 | B2 | * | 7/2006 | Jacobs et al. | 137/251.1 |
| 7,661,436 | B2 | * | 2/2010 | Singh | 137/252 |

FOREIGN PATENT DOCUMENTS

| | | |
|---|---|---|
| DE | 2649845 | 3/1978 |
| DE | 10116287 | 10/2001 |
| DE | 10035947 | 1/2002 |
| DE | 10127276 | 1/2003 |
| DE | 102005054812 | 6/2007 |
| GB | 835405 | 5/1960 |
| GB | 945688 | 1/1964 |

* cited by examiner

METHOD FOR REDUCING THE AIR FEED FROM THE ATMOSPHERE INTO THE EXPANSION VESSEL OF HIGH-VOLTAGE SYSTEMS FILLED WITH INSULATING LIQUID AND DEVICE FOR CARRYING OUT THE METHOD

BACKGROUND OF THE INVENTION

The invention relates to a method for reducing the supply of air from the atmosphere into the expansion vessel of high-voltage plants filled with insulating liquid. Furthermore, the invention relates to an apparatus for carrying out the method that differs with the new commissioning of transformers from that of transformers with already started thermal aging.

High-voltage plants, e.g. transformers, are filled with insulating liquids such as mineral oils for cooling. Load changes, variations in the performance of the cooling plants, and ambient temperatures lead to distinct temperature changes, and thus to changes of the volume of oil. The oil is received by expansion vessels above the transformer tank. In these vessels, there is a direct contact of the oil level with the atmospheric air. Pressure compensation is carried out via a conduit which at its end is sealed with an air dehumidifier and an oil cone. Additionally, air is drawn from the atmosphere at the beginning of thermal aging, when oxygen is consumed in the transformer, and also absorbed by degassed insulating liquids during new installations and repairs. Although the sealing system to the atmosphere has been successful in Europe, developments lead towards air-sealing systems that exclude the oxygen and also bypass air dehumidifying. A direct correlation can be seen from oxygen to the lifetime of the insulating system. There is both a lack of criteria for this and of reliable methods of analysis to monitoring thereof.

The known technical solutions substitute the direct air contact by use of separating diaphragms or enclose nitrogen or vacuum in the expansion vessel. These solutions have the following disadvantages:

- high costs; especially with retrofittings;
- retrofitting during the de-energized state;
- lack of criteria for the efficiency;
- due to technical limits the intended complete elimination of oxygen cannot be put into action.

Since the complex role of oxygen has not yet been clarified, so far only the lowering of oxygen content has been attained.

There are known techniques which carry out a separation of the active part in the oil itself. DE 102005054812 A1 discloses a tubular formed hollow body situated in parallel to a tank and hydraulically connected to the tank. A floating disposed sealing piston is guided therein which is loaded with an insulating liquid of a defined electrical stability of the filling of insulating oil in the tank, on the one side, and with an insulating oil being under atmospheric pressure and having any electrical stability, on the other side, wherein the insulating oil serving as blocking liquid is located in an compensation container arranged above the hollow body.

DE 10035947 B4 discloses a device for reducing the contamination of liquids caused by exposure to air and water. The device is comprised of a main reservoir in which a heat source is located that in its lower area is connected to the expansion container through a pipe leading to the ambient atmosphere. Between the pure and warm liquid, a stable layer of the heat stratification forms spontaneously under the heat source at the boundary layer to the cold, potentially contaminated liquid located beneath, which is disposed in the lower area of the main reservoir, the connecting pipe, and the expansion container.

The above mentioned disadvantages also apply to these techniques.

SUMMARY OF THE INVENTION

It is an object of the invention to effectively lower the oxygen content in an expansion vessel. Decreasing the intake of humidity from the atmosphere is a further object.

It is an object of the invention to provide an air buffer space connected to the expansion vessel of the high-voltage plant that is not static, which would otherwise restrict the possibility of intake of air from the atmosphere in response to the changing gas balance in the insulating liquid system within the predetermined boundaries. At the beginning of thermal aging of the insulating system, oxygen dissolved in the insulating liquid will be consumed to thus obtain a lowering of the oxygen content of air in the expansion vessel, causing a decrease of oxygen consumption, and lowering the intake of humidity by feedback.

With regard to the above objects, the following findings about expansion vessels in particular those having direct air contact are cited:

- the tank oil reaches the air saturation (NIS-criterion) within a time period of 6 weeks up to 18 months after the commissioning of transformers;
- an oxygen saturation concentration of approximately 32,000 ppm continues to be maintained many years until the thermal degradation of the insulating system initiates and oxidation reactions run;
- lowering the oxygen concentration in the oil has no influence on the oxygen content in the air space of the expansion vessel (found out in thermal anomalies only) since fast additional supplying from the atmosphere takes place.

The object is solved by the method and apparatus disclosed herein. As a result, the basic idea is to selectably use an external buffer space in combination with an inert gas.

The method according to the invention is characterized in that

- up to a predetermined overpressure relative to the atmospheric pressure gas is transferred from the expansion vessel into an external buffer space;
- up to a predetermined underpressure relative to the atmospheric pressure gas is transferred from an external buffer space into the expansion vessel;
- wherein the buffer volume is influenced by a lower and upper working temperatures ($T_u$, $T_o$) of the insulating liquid in the high-voltage plant.

Upon exceeding the overpressure relative to the atmospheric pressure, gas is released from the buffer space via a pipe in the wall of a smaller tank located in a larger tank.

Upon falling below the predetermined underpressure relative to the atmospheric pressure, air is transferred from the atmosphere into the buffer space through a compensation pipe and a pipe aperture in the jacket of an inner smaller tank.

In one embodiment, for a quicker, more effective reduction of the air supply from the atmosphere upon falling below the positive pressure relative to the atmospheric pressure, an inert gas is fed into said buffer space.

In another embodiment, the stability of the gas balance can be improved in that upper and lower limits are determined for the absolute pressure in the buffer space, outside of which pressure compensation to the atmosphere takes place.

A special advantage is made when, instantaneously with the application of the method, the expansion vessel and the buffer space are purged with an inert gas such as nitrogen.

By reducing the fill volume of barrier liquid in the tanks, the reduction of air supply from the atmosphere will be decreased. On the other hand, by connecting a plurality of tanks via a manifold to the air dehumidifier of the expansion vessel, the reduction of air supply from the atmosphere into the expansion vessel will be increased. The same can be achieved when the buffer space of a tank will be enlarged by an air-impermeable buffer bag.

To prove the efficiency of the reduction of air supply from the atmosphere into the expansion vessel, the absolute oxygen content in the expansion vessel will be measured.

The method can be applied both to expansion vessels having direct contact between insulating liquid and gas space and to expansion vessels having separating diaphragms.

The apparatus according to the invention is comprised of an outer closed cylindrical tank having a lid into which a second smaller cylindrical inner tank, which also has a lid, is inserted. The second smaller cylindrical inner tank opens downwardly and is spaced apart from the bottom of the outer tank. In the lower wall area of the second smaller cylindrical inner tank, a pipe is provided that leads to an upper space of the inner tank. The outer closed cylindrical tank is connected to the air dehumidifier of the expansion vessel by a pipe. A horizontal pipe having a pipe bend at its end opens downwardly, leading from the compensation space of the inner tank through the jacket of the outer tank to the outside ambient atmosphere. A diffusion barrier liquid having an accurately metered filling volume is contained in the outer and inner tanks such that a buffer space is formed in the outer tank, and a compensation space is formed in the inner tank. A single-bore stopcock is provided at the outer tank, preferably in the upper area of the wall. Likewise, on the wall of the outer tank a float-switch can be provided which is connected to a pressure tank of an inert gas by a valve.

The dimensions of both tanks as well as the filling volume of the insulating liquid are derived from the preselected working temperatures, from the predetermined pressures and the characteristics of the diffusion barrier liquid.

To enlarge the working volume of the buffer space and the compensation space, a plurality of devices can be interconnected with the air dehumidifier of the expansion vessel through a manifold. To enlarge the buffer space this one is allowed to be connected with a buffer bag being variable in volume. A pressure sensor may be inserted in the manifold in connection with a valve which opens to the atmosphere.

As a possible design, the outer and inner tanks may have a cubic or rectangular shape.

In another design, the inner tank is provided with a bottom and is disposed next to the outer tank so that one wall is shared in the lower area, of which a pipe connection is disposed in a predetermined height.

Against ambient weather conditions there is provided a protection from solar radiation and a heating against extreme sub-zero temperatures.

The entire device is not lockable, i.e., it permits inflow of ambient air and/or inert gas. Oxygen in the ambient air can be diffused out across the liquid diffusion barrier, so that the operator can maintain the system according to status quo or otherwise restart the process with new air or inert gas.

The method according the invention and the apparatus for carrying out the method offer the following advantages:

- the degradation of the insulating system by the presence of moisture and oxygen can be limited, and the lifetime of the high-voltage plant can be extended;
- the oxygen dissolved in the liquid enters the high-voltage plant by convection, and is consumed at the beginning of thermal aging of the insulating system without feeding new oxygen from the outside;
- from routine monitoring, the timing of the installation of the apparatus can be determined. Installation should coincide with the beginning of the thermal aging of the insulating system, at the latest;
- equipment and installation are economically priced; no interruption of the operation is necessary for the installation;
- the efficiency of oxygen lowering can be traced by analyses of the gas of the expansion vessel;
- the efficiency of oxygen lowering can be changed by changing the filling level of the insulating liquid in the apparatus;
- a plurality of devices can be interconnected, and/or an apparatus can be coupled to a buffer bag, to allow for adaptation to the dimension of the expansion vessel and efficiency of oxygen lowering;
- the application of the apparatus is free of maintenance and relieves the mode of operation of the air dehumidifier at the expansion vessel;
- the introduction of an inert gas when the pressure is negative pressure relative to the atmospheric pressure allows a faster and stronger reduction of air supply from the atmosphere;
- the open sealing system of the transformer is converted into a relatively closed one, and in the expansion vessel an approximately online-balance gas is developing which is very interesting for analytical monitoring.

DETAILED DESCRIPTION OF THE INVENTION

Figure 1:
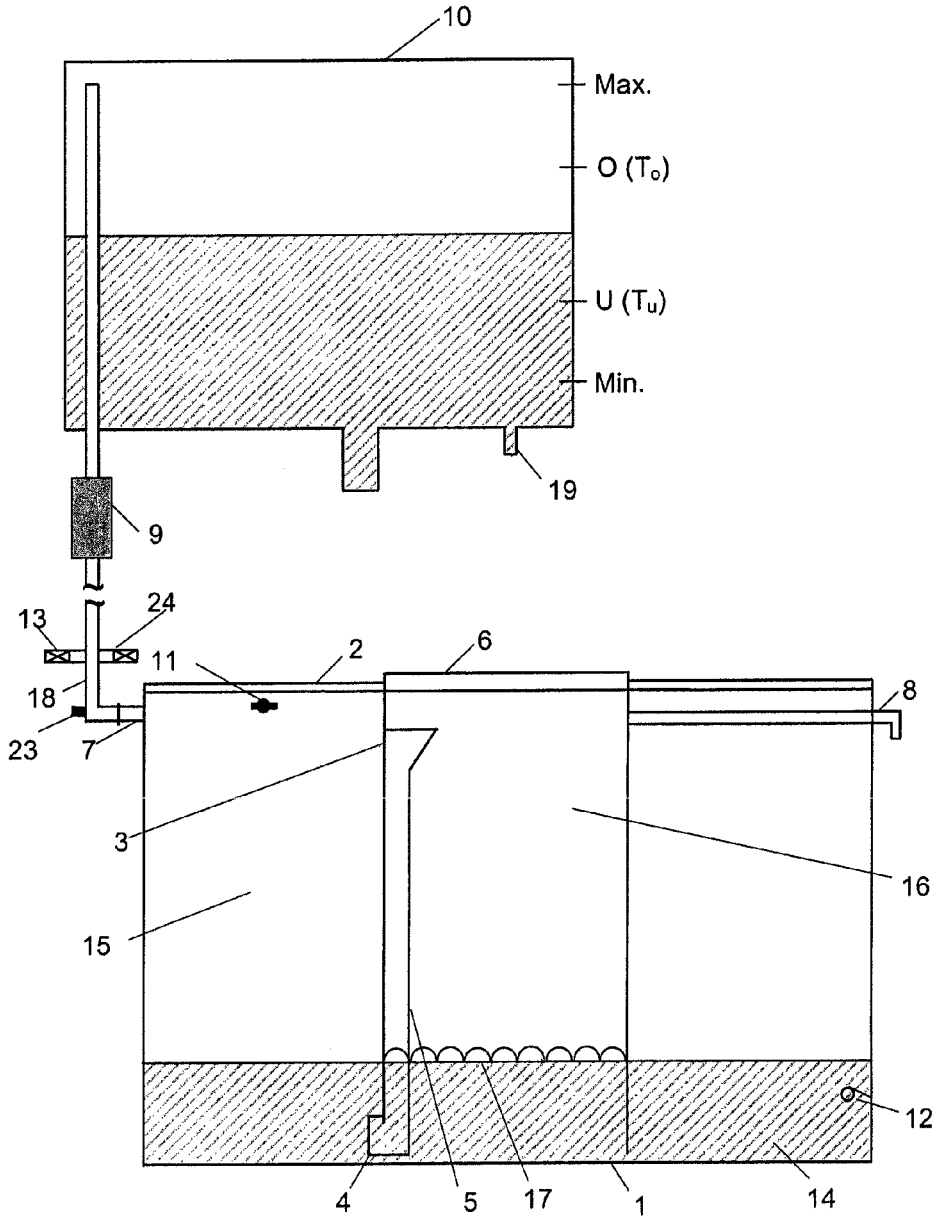
FIG. 1 shows a schematic view of the apparatus according to the invention connected to an expansion vessel.

FIG. 1 shows a schematic view of the apparatus according to the invention. The apparatus is positioned on the expansion vessel of a transformer to which the apparatus is connected or disconnected. The apparatus is comprised of an outer, closed cylindrical tank 1 in the lid 2 of which a second smaller cylindrical tank 3 is inserted centrally. The tanks 1 and 3 may be in cubic or rectangular shapes as well. The inner tank 3 is bottomless and is spaced from the bottom of the outer tank 1. The lower part of the inner tank wall has a pipe aperture 4 leading into the upper part of the tank 3 via a pipe 5. The inner tank 3 is provided with a lid 6.

The wall of the tank 1 has a nozzle 7 extending therefrom and positioned beneath the upper edge. The wall of the tank 1 is further provided with a single-bore stopcock 11. Disposed on the wall of the outer tank 1 near the tank bottom is a float-switch 12 connected to a pressure container of an inert gas by valve 13. In the upper part of the wall of the inner tank 3, a compensation pipe 8 is inserted and leads horizontally through the wall of the outer tank 1 to outside the tank, and is provided with a downward facing spout. Thus, the compensation pipe accesses the outside ambient atmosphere.

Figure 2:
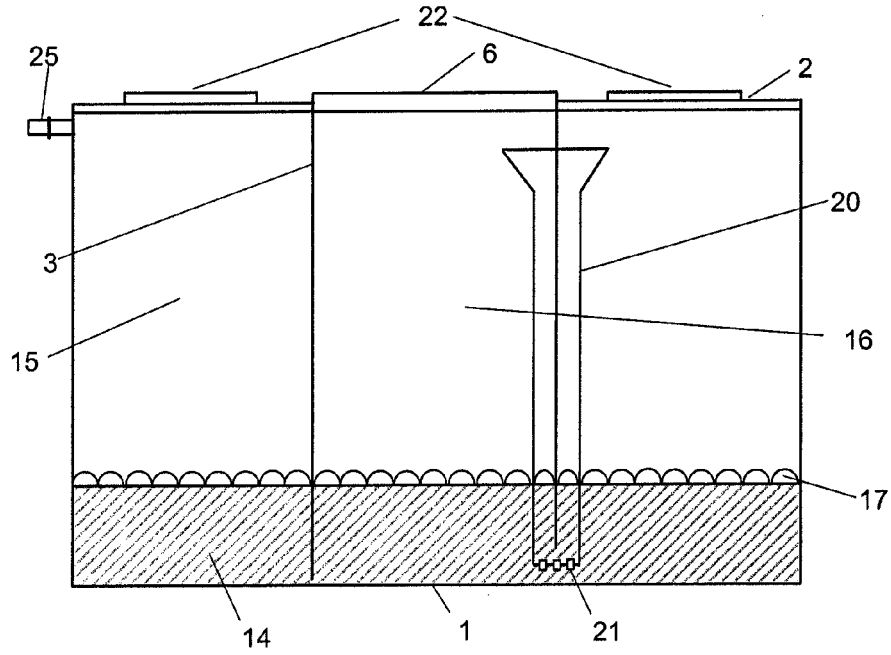
FIG. 2 shows an embodiment provided with additional floating bodies as well as a nozzle for a buffer bag.

The lid 6 of the tank 3 can be removed to allow for partial filling of tank 1 and tank 3 with a predetermined volume of an diffusion barrier liquid 14, e.g. transformer oil, which may be without any quality requirements. With partial filling, the outer tank 1 has a buffer space 15 above the diffusion barrier liquid 14 which is in connection with the air space of the expansion vessel 10 through the air dehumidifier 9, and forms a unit with it. Further, a compensation space 16 is located in the tank 3 above the diffusion barrier liquid 14. The insulating liquid 14 functions as a diffusion barrier for oxygen between the air in the expansion vessel 10 and the atmosphere. The pipe aperture 4 in the pipe 5 allows for free gas exchange between buffer space 15 and the atmosphere in order not to move the diffusion barrier liquid 14 as the diffusion barrier. To enhance this effect, floating bodies 17 can be inserted in tank 3 and in the pipe 5 to cover the surface of the diffusion barrier liquid. To reinforce the diffusion barrier, in an alternative embodiment shown in FIG. 2, the pipe 5 can be provided in a U-tube 20 configuration having openings 21 at the bottom thereof that communicate with the tank 1. Floating bodies 17 may be also be employed when the U-tube configuration is employed. For example, the floating bodies 17 can be placed in the tank 1 through a pair of lids 22 in the top 2. A nozzle having a cap 25 is provided in the upper part of the wall of the outer tank 1 for connecting to a buffer bag.

The dimensions of both tanks I and 3 as well as the filling volume of the diffusion barrier liquid 14 are derived from the selected working temperatures, the predetermined pressures, and the characteristics of the diffusion barrier liquid.

Preferably, the outer tank 1 is protected against solar radiation on its exterior in order to suppress differences in temperature within the diffusion barrier liquid 14. In addition, a heating element can be used to heat the diffusion barrier liquid when outside temperatures are very cold. Installation of the device according to the invention has to be carried out horizontally.

The tank 1 thus installed has the following mode of operation.

The connection from the outer tank 1 to the air dehumidifier 9 is made through manifold 18 at atmospheric pressure. An oil level is set in the expansion vessel 10 between first upper level O and second lower level U to which the working temperatures $T_o$ and $T_u$ are assigned. The levels O and U are between the minimum/maximum values for same, as shown in FIG. 1. The manifold 18 includes a pressure sensor 23 and a valve 24 communicating with the atmosphere. If the oil temperature in the expansion vessel 10 decreases towards $T_u$ the oil level increases in the outer tank 1, or if the tank oil temperature increases in the direction of $T_o$, the oil level increases in the inner tank 3. The dimensions of tanks 1 and 3 as well as the filling volume of the diffusion barrier liquid 14 are set to a predetermined value so that within the selected working temperatures $T_u$ and $T_o$, the air pressure in the expansion vessel 10 is within the predetermined pressure which optimally is in the natural variation range of atmospheric pressure.

When outside of the temperatures $T_u$ and $T_o$, the intake of atmospheric air into the outer tank 1 and the release of air from the expansion vessel 10, respectively, take place via tank 1. Variations in the atmospheric pressures are slightly buffered via the outer tank 1.

The working temperatures $T_u$ and $T_o$ can be preset according to highest summer temperature and the lowest winter temperature of the tank oil at the location where it will be in operation. For temperatures below $T_u$, a limited air supply can be drawn from the atmosphere. The small intake of oxygen is again consumed in the dissolved state.

When the temperature exceeds the value of $T_o$, air is released to the atmosphere. Thus, according to the invention, there is a self regulating natural system between the set pressure limits which does not require any maintenance. A pressure sensor 23 is employed to maintain pressure within the range that corresponds to the expected variations in atmospheric pressure, thereby avoiding extreme pressure values. With deviations from the predetermined range of pressure, the equalization with the atmosphere takes place through valve 24 over time.

The added height of the liquid column in the outer tank 1 and the inner tank 3 is the temporally changing diffusion barrier to gases, and in particular, as a barrier to oxygen, provided by the diffusion barrier liquid 14 in the tanks 1 and 3. Parallel to the air buffering in the outer tank 1 a gas exchange between the air and the tank liquid takes place. The dissolved oxygen will be consumed in the active part with the beginning of thermal aging of the insulating system. By the continuous feedback of these actions the oxygen content of air in the expansion vessel 10 and also in the buffer space 15, respectively, incrementally decreases. As a result, the supply of oxygen from the expansion vessel 10 to the tank stops. The quality of the diffusion barrier limits the maximum lowering of oxygen.

With higher requirements, quicker, more effective lowering of the oxygen content of air in the expansion vessel 10 can be achieved by purging the expansion vessel 10 and the outer tank 1 by charging an inert gas into the supply-line 19 of the expansion vessel 10 via the single-bore stopcock 11.

Air samples can be drawn from the single-bore stopcock 11 in order to monitor the oxygen content and the efficiency at which it is changed.

The efficiency at which oxygen content is lowered in the expansion vessel 10 is based on the absolute oxygen content in the air space itself. From this determination, the dissolved oxygen contents can be inferred, not vice versa.

Air from the atmosphere can be prevented from entering the buffer space 15 when the pressure in the space 15 falls below a predetermined negative pressure relative to the atmospheric pressure by feeding an inert gas into outer tank 1 via a valve 13, controlled by a float-switch 12 at the wall of the outer tank 1. Feeding inert gas can occur at maximum gas flow until the positive pressure relative to the atmospheric pressure is reached which is, calculated in the simplest case, feasible through a time limit. Dehumidified air will be preserved since air cannot enter the system from the outside the air dehumidifier.

Preferably, the disclosed apparatus and method are employed in new installations and operating conditions in which a degasified insulating liquid is present.

When sensor 23 indicates that negative pressure is attained relative to the atmospheric pressure, valve 13 can be switched instead of valve 24.

Figure 3:
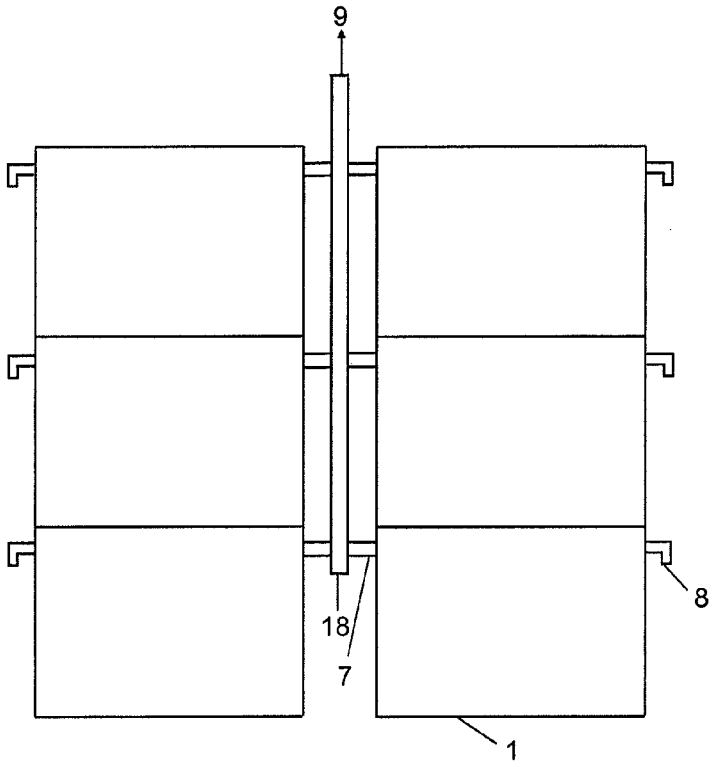
FIG. 3 shows a schematic view of a plurality of devices stacked on top of each other and next to each other.

Dimensions of the disclosed apparatus of FIG. 1 are defined in terms of optimized standard sizes. Also, for larger expansion vessels 10, several devices according to FIG. 1 can be interconnected horizontally and/or vertically via the nozzle 7 to a manifold 18 upstream of the air dehumidifier 9 (FIG. 3). Alternatively, or additionally, a buffer bag 25 may also be connected via the nozzle 25.

In another embodiment, not shown herein, a larger closed tank is connected to the air dehumidifier 9 of the expansion vessel 10 via a nozzle, and a second smaller tank having a bottom is disposed next to the outer tank, with the two tanks sharing a common wall. In the shared wall, a pipe joint is provided in the lower area in a specified height. In both tanks, an insulating liquid having a predetermined filling volume is contained such that in the larger tank a buffer space is formed, and in the smaller tank a compensation space is formed. In the upper part of the jacket or in the lid of the smaller tank a compensation pipe is inserted which is bent and opened downwardly.

The method according to the invention may also be applied with compensation vessels having a separating diaphragm.

The invention claimed is:

1. A method for reducing the air present in a high voltage power plant comprising:

providing an apparatus comprising:

an expansion vessel having a volume partially filled with an insulating liquid, at least a portion of a remainder of the expansion vessel volume being a space for retaining air from the atmosphere, a first tank and a second tank positioned inside of and being smaller than the first tank, the first tank and second tank having lids at the tops thereof, the first tank and second tank having a volume partially filled with a diffusion barrier liquid, the first and second tank having a common opening located below a fill line of the diffusion barrier liquid for permitting the movement of liquid between the first and second tank, the first tank having an external buffer space present in a portion of a remainder of the volume of the first tank, the second tank having a compensation space present in a portion of a remainder of the volume of the second tank, a flow line between the space for retaining air from the atmosphere in the expansion vessel and the external buffer space in the first tank, a compensation flow line between an ambient atmospheric environment and the compensation space in the second tank, a pipe positioned in the second tank for permitting air flow between the compensation space and the diffusion barrier liquid; whereby the diffusion barrier liquid provides a barrier to diffusion of at least the oxygen component of air from an atmosphere side of the diffusion barrier liquid to the external buffer space on an expansion vessel side of the diffusion barrier liquid;

determining the volume of the external buffer space through predetermined designation of an upper working temperature and a lower working temperature of the insulating liquid;

transferring gas in the space in the expansion vessel to the external buffer space up to a predetermined overpressure relative to atmospheric pressure;

transferring gas from the external buffer space to the expansion vessel until attaining a predefined value of underpressure relative to atmospheric pressure;

releasing gas from the external buffer space in the first tank when the predefined overpressure value is exceeded through displacement of the diffusion barrier liquid in the first tank though the pipe in the second tank; and drawing gas into the external buffer space from the atmosphere into the first and second tank though the compensation flow line when the pressure in the external buffer space falls below the predefined underpressure value.

2. The method of claim 1, further comprising introducing an inert gas into the external buffer space when the pressure in the external buffer space falls below the predefined underpressure value, whereby the quantity of air drawn into the external buffer space from the atmosphere into the first and second tank though the compensation flow line is rapidly reduced.

3. The method of claim 1, further comprising purging the expansion vessel and external buffer space with an inert gas at a predetermined time.

4. The method of claim 1, further comprising reducing the volume of insulating liquid from a first level, whereby the quantity of air drawn from the atmosphere into said expansion vessel is decreased.

5. The method of claim 1, further comprising providing a manifold and an air dehumidifier in the flow line between the space in the expansion vessel for retaining air from the atmosphere and the external buffer space in the first tank and operating the air dehumidifier, whereby air having a reduced moisture content is provided to the expansion vessel.

6. The method of claim 5, further comprising measuring an absolute pressure of the air in the manifold;

adjusting the absolute pressure of the air by activating a valve in communication with the atmosphere that is positioned in the flow line between the space for retaining air from the atmosphere in the expansion vessel and the external buffer space in the first tank, if a deviation in a predetermined upper limit of the absolute pressure is detected;

adjusting the absolute pressure of the air by activating at least one of the valve in communication with the atmosphere that is positioned in the flow line between the space for retaining air from the atmosphere in the expansion vessel and the external buffer space in the first tank and a valve in communication with an inert gas supply and positioned in the flow line between the space for retaining air from the atmosphere in the expansion vessel and the external buffer space in the first tank, if a deviation in a predetermined lower of the absolute pressure is determined.

7. The method of claim 1, further comprising measuring the oxygen content of the air present in the expansion vessel to determine the effectiveness of the reduction of components of the air.

8. The method of claim 1 further comprising connecting a buffer bag to the flow line between the space for retaining air from the atmosphere in the expansion vessel and the external buffer space in the first tank, whereby the buffer bag increases the volume of the internal buffer space.

9. An apparatus for lowering the oxygen content of air present in an expansion vessel of a high-voltage power equipment, comprising:

an expansion vessel having a volume partially filled with an insulating liquid, at least a portion of a remainder of the expansion vessel volume being a space for retaining air from the atmosphere;

a first tank and a second tank positioned inside of and being smaller than the first tank, the first tank and second tank having lids at the tops thereof, the first tank and second tank having a volume partially filled with a diffusion barrier liquid, the first and second tank having a common opening located below a fill line of the diffusion barrier liquid for permitting the movement of the diffusion barrier liquid between the first and second tank, the first tank having an external buffer space present in a portion of a remainder of the volume of the first tank, the second tank having a compensation space present in a portion of a remainder of the volume of the second tank, a flow line between the space for retaining air from the atmosphere in the expansion vessel and the external buffer space in the first tank, a compensation flow line between an ambient environment having atmospheric air and the compensation space in the second tank, a pipe positioned in the second tank for permitting air flow between the compensation space and diffusion barrier liquid; whereby the diffusion barrier liquid provides a barrier to diffusion of at least the oxygen component of air from an atmosphere side of the diffusion barrier liquid and the external buffer space on an expansion vessel side of the diffusion barrier liquid.

10. The apparatus of claim 9 wherein the second tank further comprises a bottom having openings, the second tank being disposed next to the first tank, the first and second tank sharing a common wall, the common wall being provided with the pipe, the pipe extending to a predetermined height; the compensation flow line being provided with a bend at a downward end and having an opening on the bend.

11. The apparatus of claim 9 wherein the wall of the first tank is provided with a switch for activating a valve for introducing a pressurized inert gas into the external buffer space.

12. The apparatus of claim 9 further comprising floating bodies on a surface of the diffusion barrier liquid in the second tank.

13. The apparatus of claim 9 wherein the pipe is provided in a U-tube configuration having openings in the bottom of the U-tube configuration, and floating bodies on a surface of the diffusion barrier liquid in the U-tube configuration, the first tank, and the second tank.

14. The apparatus of claim 9 further comprising a buffer bag connected to the flow line between the space for retaining air from the atmosphere in the expansion vessel and the external buffer space in the first tank, whereby the buffer bag increases the volume of the internal buffer space.

15. An interconnected arrangement for lowering the oxygen content of air present in an expansion vessel of a high-voltage power equipment, comprising:

a plurality of apparatuses in an interconnected arrangement, each apparatus comprising:

a first tank and a second tank positioned inside of and being smaller than the first tank, the first tank and second tank having lids at the tops thereof, the first and second tank having a volume partially filled with a diffusion barrier liquid, the first and second tank having a common opening permitting the movement of diffusion barrier liquid between the first and second tank, the first tank having an external buffer space present in a portion of a remainder of the volume of the first tank, the second tank having a compensation space present in a portion of a remainder of the volume of the second tank, a compensation flow line between an ambient environment having atmospheric air and the compensation space in the second tank, a pipe positioned in the second tank for permitting air flow between the compensation space and diffusion barrier liquid; whereby the diffusion barrier liquid provides a barrier to diffusion of at least the oxygen component of air from an atmosphere side of the diffusion barrier liquid and the external buffer space on an expansion vessel side of the diffusion barrier liquid, a nozzle provided in the first tank on the expansion vessel side of the diffusion barrier liquid;

a plurality of nozzles of the apparatuses being connected to a manifold having a flow direction leading to an air dehumidifier, the dehumidifier having a flow line for introducing air to an expansion vessel having a volume partially filled with an insulating liquid, at least a portion of a remainder of the expansion vessel volume being a space for retaining air from the atmosphere.

* * * * *